US006000346A

United States Patent [19]

Pajerski et al.

[11] Patent Number: 6,000,346

[45] Date of Patent: Dec. 14, 1999

[54] LEG MOUNTING DEVICE AND RELATED TABLE

[75] Inventors: Francis L. Pajerski, Elkhorn, Wis.; Kenneth R. Hootnick, Littleton, Colo.

[73] Assignee: Palmer Snyder Furniture Co., Milwaukee, Wis.

[21] Appl. No.: 09/078,805

[22] Filed: May 14, 1998

[51] Int. Cl.[6] ..... A47B 3/06

[52] U.S. Cl. ..... 108/158.11; 108/130

[58] Field of Search ..... 108/153.1, 158.11, 108/159.12, 129, 130; 248/439, 188, 188.6

[56] References Cited

U.S. PATENT DOCUMENTS

| | | | |
|---|---|---|---|
| 3,190,596 | 6/1965 | Kaminky | 108/130 |
| 3,269,337 | 8/1966 | Peterson | 108/130 |
| 3,854,828 | 12/1974 | Jones | 108/129 X |
| 4,135,691 | 1/1979 | Wiesmann | 108/129 X |
| 4,392,437 | 7/1983 | Wallace | 108/129 X |
| 4,630,550 | 12/1986 | Weitzman | 108/158.11 X |
| 4,691,885 | 9/1987 | Lawrance | 108/158.11 X |
| 4,714,224 | 12/1987 | Calmes | 248/439 X |
| 4,907,770 | 3/1990 | Marchetti | 248/188.6 |
| 5,269,230 | 12/1993 | Nakamura | 108/153.1 X |
| 5,394,808 | 3/1995 | Dutro et al. | 108/130 X |
| 5,497,706 | 3/1996 | Yong | 108/129 X |

*Primary Examiner*—Peter M. Cuomo
*Assistant Examiner*—Hanh Tran
*Attorney, Agent, or Firm*—Janson, Shupe, Bridge & Munger, Ltd.

[57] ABSTRACT

A leg mounting device for a table includes a body portion having a bar receiving cavity formed at a radius and extending along a first axis. A nose portion extends from the body portion along a second axis angled with respect to the first axis. Conveniently, the device has a plurality of mounting holes through the body portion. A related table includes a top member having first and second corner components and an undersurface. First and second leg mounting devices are adjacent to the first and second corner components, respectively, and are fixed with respect to the undersurface. Each mounting device includes a body portion having a bar receiving cavity as noted above and the table includes an elongate leg bar extending between the devices and received in the cavity of each mounting device.

17 Claims, 4 Drawing Sheets

LEG MOUNTING DEVICE AND RELATED TABLE

FIELD OF THE INVENTION

This invention relates generally to horizontally supported planar surfaces such as tables and, more particularly, to tables having folding legs.

BACKGROUND OF THE INVENTION

In general, tables are configured to have rigidly attached, non-folding legs or legs which fold, thereby configuring the table for space-saving storage. Examples of the former include office tables and residential dining room and coffee tables. And examples of the latter include card tables and institutional tables.

Institutional tables are so named because, in large part, they are used by schools, hospitals, gaming halls and the like where the requirement is for a sturdy table capable of accommodating a number of persons seated around it. Another requirement is that the table be configured for easy folding and storage. Palmer/Snyder Furniture Co. is a leading designer and manufacturer of institutional tables.

An aspect of institutional tables to which a good deal of creative effort has been directed involves the mounting arrangements for the folding legs. Merely as examples, U.S. Pat. Nos. 2,796,268 (Larson) and 4,557,200 (Geschwender) disclose tables or table-like products having folding legs.

The Larson patent discloses a folding table having a leg bracket structure with two end portions connected by a strap portion. Each end portion has a vertical portion, each with an aperture through it.

Each of the rod-like leg portions has a right-angle, outwardly turned pivot portion. Such portions extend entirely through the respective apertures in the vertical portions. Seemingly, such leg bracket structure is rather difficult and time-consuming to assemble.

The Geschwender patent discloses a tray with a pair of U-shaped legs, each of which is secured to the tray by two pivot members. The perimeter skirt of the table is separate from and spaced away from the pivot members.

Notably, these pivot members (as well as the leg end portions which engage them) differ from one another. One pivot member has a single vertical flange through which a right-angle leg end portion extends. The other pivot member has two vertical flanges through which a longer end portion extends.

While these earlier arrangements have presumably been acceptable for their intended purposes, they are not without disadvantages. For example, the table disclosed in the Larson patent has no under-table side beams to add rigidity to the surface and to mask the leg pivot hardware from view when the table is in use. Many would consider this aesthetically unattractive.

Another disadvantage, particularly in applications requiring tables of varying width, is that in the leg-mounting brackets, the vertical tabs which pivotally receive the leg portions are connected together by a strap of fixed length. If one is required to offer tables of varying width, it is necessary to make and stock brackets having straps of varying length.

U.S. Pat. No. 4,727,816 (Virtue) has four corner members, each of which receives the ends of two stringers. Slots in the corner members are shaped to closely conform to the shape of the ends of the stringers. Seemingly, this requires careful, close-fitted assembly. And each axle member of each leg assembly is attached to the side stringers by a pair of bearing assemblies for pivoting movement. Attachment is well inwardly from the table ends resulting in some loss of stability as well as, seemingly, increased cost.

A leg mounting device and related table which address some of the problems and shortcomings of the prior art would be significant advances in this field.

OBJECTS OF THE INVENTION

It is an object of the invention to provide an improved leg-mounting device and related table which overcome some of the problems and shortcomings of the prior art.

Another object of the invention is to provide an improved leg-mounting device which easily accommodates variations in table width.

Another object of the invention is to provide an improved leg mounting device which affords reduced cost in table manufacture.

Yet another object of the invention is to provide an improved leg-mounting device which, in use, is easy to assemble.

Another object of the invention is to provide an improved leg-mounting device which readily accommodates the table legs.

Still another object of the invention is to provide an improved table having leg-mounting devices affording the aforedescribed benefits. How these and other objects are accomplished will become apparent from the following descriptions and from the drawings.

SUMMARY OF THE INVENTION

The invention involves a unique leg-mounting device for a table. The device includes a body portion having an arch-like, closed-ended bar-receiving cavity formed in it at a radius and extending along a first axis. A protruding nose portion extends from the body portion along a second axis angled with respect to the first axis and, most preferably, perpendicular to the first axis. Conveniently, the device has a plurality of mounting holes molded through the body portion.

The body portion has a face intersecting the first axis and the cavity includes (and is bounded by) an outward edge coincident with the face. While the face may be curved or orthogonal, in a highly preferred device the face is flat and such face and the outward edge are coincident with a plane.

The leg-mounting device has enlarged first and second chambers formed in the body portion and in the nose portion, respectively, and extending substantially parallel to the first axis and to the second axis, respectively. As further described below, the chambers receive longitudinal and lateral support beams, respectively, with very substantial chamber/beam clearance.

Each chamber includes a generously-large apron component which receives the thin apron member of a support beam and which has substantially uniform width along its height. Each chamber also has a vestigial flange component which receives the flange member of the support beam and which has substantially uniform height along its width. In a specific embodiment of a support beam, its apron and flange component are perpendicular to one another.

In another aspect of the invention, the cavity includes an outward boundary edge and a closure wall spaced from the outward edge along the first axis. A preferred cavity is shaped like a Roman arch in that it has a half-cylinder bearing surface formed at the above-noted radius. A pair of spaced-apart retention surfaces are coextensive with the bearing surface. As to a particular cavity, each of its retention surfaces is substantially planar and such surfaces are spaced apart by a dimension substantially equal to twice the radius.

In yet another aspect of the invention, a table includes a top member and a plurality of leg-mounting devices fixed with respect to the top member. As noted above, each leg-mounting device includes a body portion having a bar-receiving cavity formed therein at a radius and extending along a first axis. A nose portion extends from the body portion along a second axis angled with respect to the first axis and a plurality of mounting holes are through the body portion.

The table top member has first and second corner components and an undersurface. First and second leg-mounting devices are adjacent to the first and second corner components, respectively, and are fixed with respect to the undersurface. In a specific embodiment, such devices abut such undersurface but, of course, the invention does not preclude the possibility of some sort of intervening structure, a pad or the like, between a device and the table undersurface.

Each mounting device includes a body portion having a bar-receiving cavity formed in it and the table includes an elongate, linear (i.e., free of bends) leg bar extending between the devices and received in the cavity of each mounting device. The leg bar has first and second ends terminated in first and second circular end edges, respectively.

The first and second ends are received in the first and second mounting devices, respectively, and the cavities of such devices include first and second closure walls, respectively. Such closure walls substantially cover the first and second end edges, respectively.

A highly preferred mounting device is molded of plastic material and includes a mounting surface which, when such device is mounted with respect to the table top member, is proximate the undersurface of such member. The mounting device also has an exterior surface spaced from and below the mounting surface. For greatest strength, the mounting device is molded solid between its exposed working surfaces. However, for reasons relating to possible shrinkage in the mold and to reduction of the volume of plastic material required to make each device, such device is preferably molded with a number of partially-hollowed-out regions. A device made in this way is somewhat less structurally "robust" but is nevertheless sufficiently strong for the intended purpose.

Further details of the new mounting device and related table are set forth in the following detailed description and in the drawings.

BRIEF DESCRIPTIONS OF THE DRAWINGS

DETAILED DESCRIPTIONS OF PREFERRED EMBODIMENTS

Figure 1:
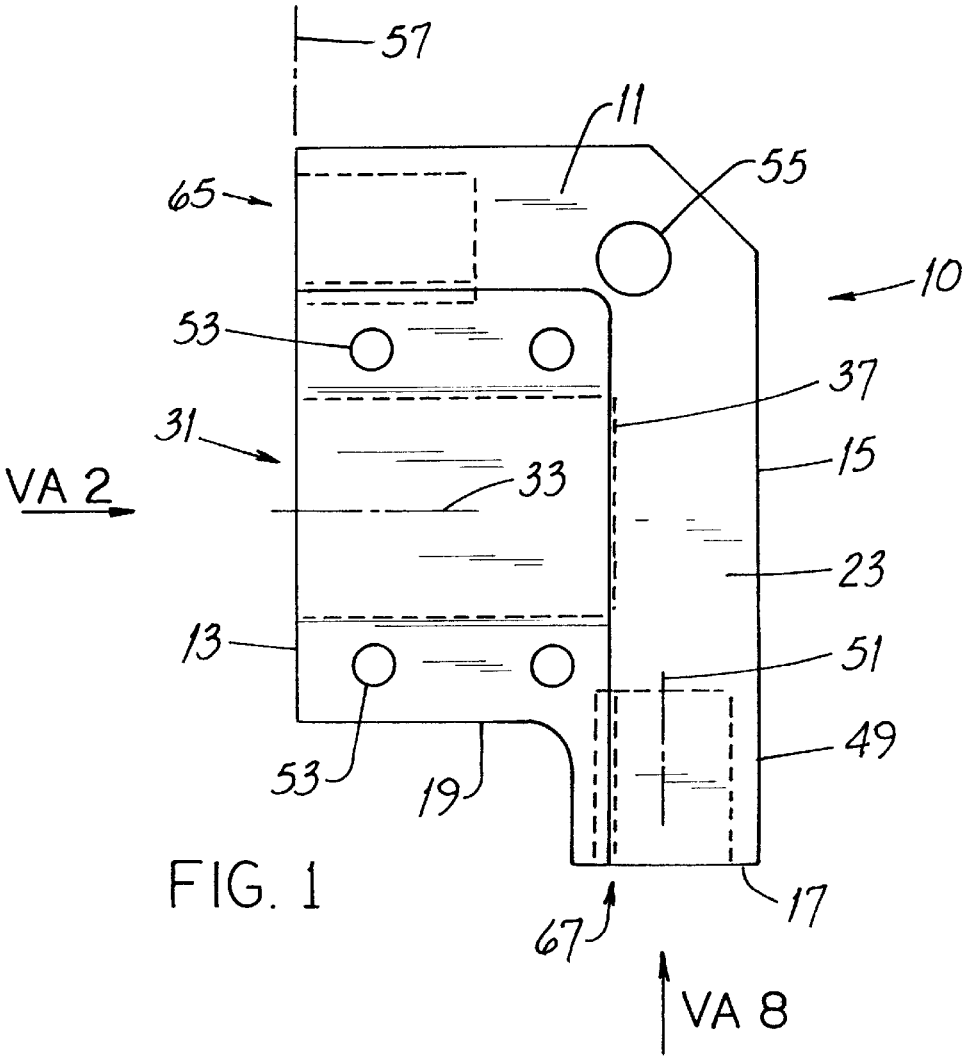
FIG. 1 is a plan view of the new leg-mounting device, such view being of the device undersurface (as defined in the specification).
Figure 2:
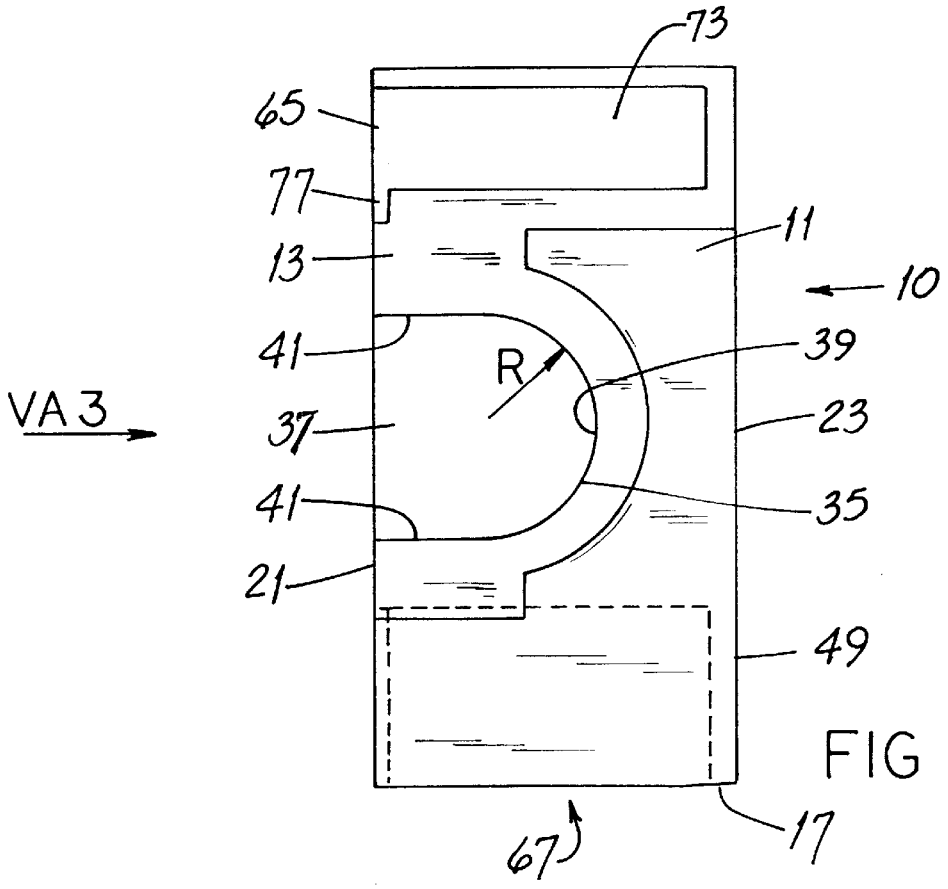
FIG. 2 is an elevation view of the device of FIG. 1 taken along the viewing axis VA2 thereof.
Figure 3:
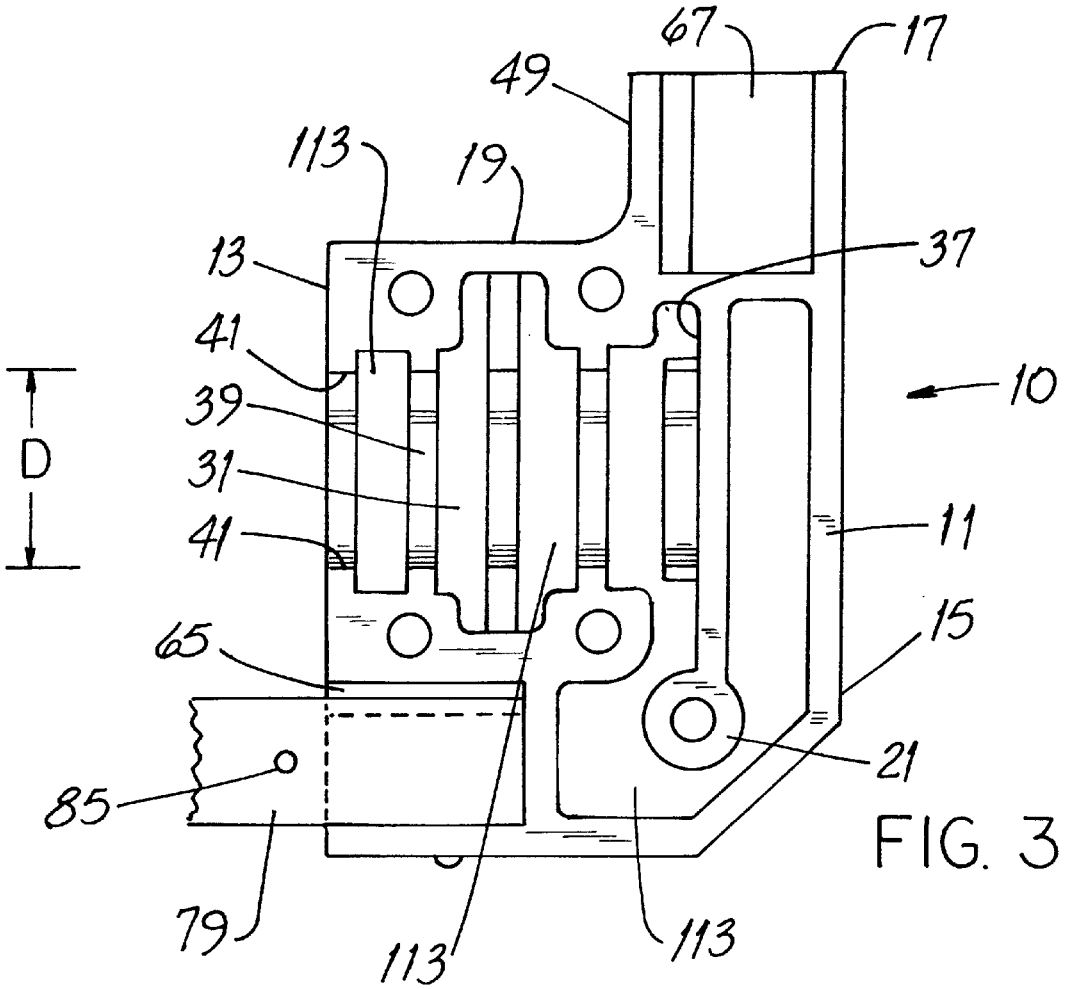
FIG. 3 is a view of the device of FIG. 1 taken along the viewing axis VA3 of FIG. 2.

Referring first to FIGS. 1, 2, 3 and 4, the new leg-mounting device 10 includes a body portion 11 generally bounded by a first face 13, an exterior wall 15, a second face 17 and an interior wall 19. The faces 13, 17, and the walls 15, 19, are contiguous to one another as shown in FIGS. 1 and 3. The body portion 11 also includes a mounting surface 21 and an undersurface 23, which are parallel to one another and contiguous with the faces 13, 17 and the walls 15, 19.

The exterior and interior walls 15, 19 are so named because they face toward the outside and toward the interior of the table 25 when mounted for leg attachment. Similarly, the mounting surface 21 is so named because it is the surface close to (or against) the table top member 27. The undersurface 23 is so named because it is under and spaced from the mounting surface 21. That is, the mounting surface 21 is upward and the undersurface 23 is downward when the table 25 is set up for use.

Referring to FIGS. 1–5, the device 10 includes a closed-ended bar-receiving cavity 31 formed in it at a radius R and extending along a first axis 33. The cavity 31 has an outward boundary edge 35 and a closure wall 37 spaced from the outward edge 35 along the first axis 33. A preferred cavity 31 is shaped generally like a Roman arch in that it has a half-cylinder bearing surface 39 formed at the above-noted radius R and also has a pair of substantially flat, spaced-apart retention surfaces 41 coextensive with the bearing surface 39. As to a particular cavity 31, each of its retention surfaces 41 is substantially planar and the surfaces 41 are spaced apart by a dimension D substantially equal to twice the radius R. As further described below, each cavity 31 of each laterally-opposed pair of devices 10, e.g., devices 10*a* and 10*b* in FIGS. 4 and 5, receives a respective end 43*a*, 43*b* of a linear (i.e., free of bends), tubular leg bar 45 shown in FIGS. 6 and 7.

Referring further to FIGS. 1, 2 and 3, a protruding nose portion 49 extends from the body portion 11 along a second axis 51 angled with respect to the first axis 33 and, most preferably, perpendicular to the first axis 33. Conveniently, the device 10 has a plurality of mounting locations 53 molded in the body portion 11 generally perpendicular to the surfaces 21, 23. In a specific embodiment, there are two locations 53 on either side of the cavity 31. If desired or needed, the device 10 may also include an opening 55 to receive a resilient spacer pad.

A plane 57 coincident with the face 13 intersects the first axis 33 and the cavity outward edge 35 is coincident with the face 13. While the face 13 may be curved, in a highly preferred device, the face 13 is flat. Such face 13 and the outward edge 35 are coincident with a plane 59 perpendicular to the surfaces 21, 23 and when the device 10 is mounted on a table 25, to the table top member 27.

Referring particularly to FIGS. 1, 2 and 3, the leg-mounting device 10 has first and second chambers 65, 67, respectively, which are formed in the body portion 11 and in the nose portion 49, respectively. The chambers 65, 67 extend substantially parallel to the first axis 33 and to the second axis 51, respectively. As further described below, the chambers 65, 67 receive longitudinal and lateral support beams 69, 71, respectively, with considerable spacing.

Figure 8:
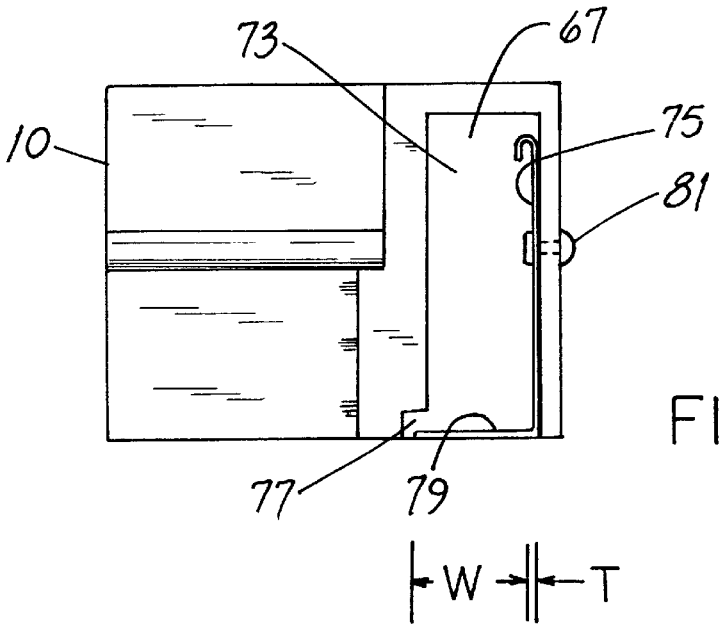
FIG. 8 is a view of the mounting device of FIG. 1 taken along the viewing axis VA8 thereof. The device is shown in conjunction with a support beam.
Figure 9:
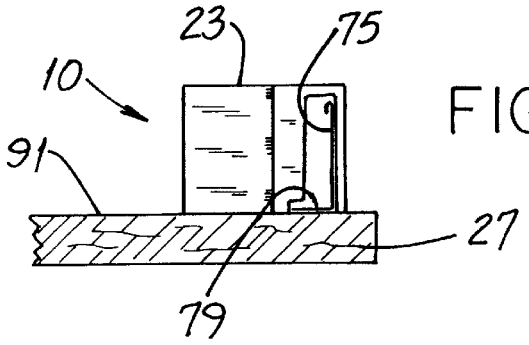
FIG. 9 is a section view taken along the viewing plane 9—9 of FIG. 4. Parts are broken away.

Referring also to FIGS. 8 and 9, each chamber 65, 67 primarily comprises an apron component 73 which receives the apron member 75 of a support beam 69 or 71 and which has substantially uniform width along its height. Each chamber 65, 67 also has a vestigial flange component 77 which receives the flange member 79 of a support beam 69 or 71 and which has substantially uniform height along its short width. In a specific embodiment of the device 10, the apron and flange components 73, 77 are perpendicular to one another. When the table 25 is set up for use, the apron components 73 are vertical and the flange components 77 are horizontal.

Referring particularly to FIG. 8, the apron member 75 has a thickness T and the chamber 67 has a width W which is several times T. To state it in other words, the width W of the chamber 67 is so much greater than the thickness T of the apron member 75 that the support beams 69, 71 and the devices 10 used to mount leg bars 45 can be mounted to the top member 27 simultaneously and with no close fitting required. The spatial relationship of the chamber 65, on one hand, and, on the other hand, the apron member 75 and flange member 79 of a beam 71 is generally as described above. (It is also to be appreciated that the configuration of the device 10 permits the assembler of the table 25 to first mount the support beams 69, 71 and then mount the devices 10 which "capture" the leg bars 45.)

Figure 10:
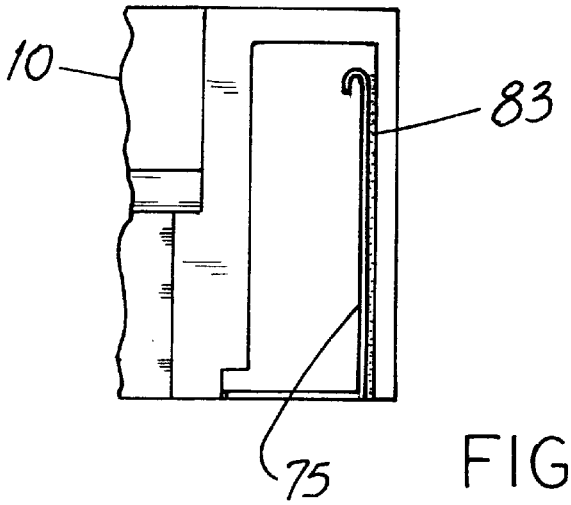
FIG. 10 is a view generally like that of FIG. 8 and showing another way to attach a support beam and a device to one another.

Referring particularly to FIG. 8, the apron member 75 and the device 10 may be attached to one another by a fastener 81 such as a pop rivet, screw, bolt, cotter pin, drive rivet or the like. But a fastener 81 is not the only way to attach the apron member 75 and the device 10 to one another. Referring to FIG. 10, attachment may be by a layer of adhesive material 83, e.g., double-sided tape or glue, between the apron member 75 and the device 10. And irrespective of how the apron member 75 and device 10 are attached to one another (if they are attached to one another), it is preferred that several screws are spaced along the beam flange member 79 to secure such member 79 to the table top member 27. A hole 85 for a screw is shown in FIG. 3.

It is also to be appreciated that the apron member 75 and device 10 need not be attached to one another as, e.g., by a rivet, by adhesive material or by any other means. Assuming a sufficiently rigid support beam 69 or 71, its apron member 75 and its flange member 79 are simply permitted to "float" in the chamber 65, 67 during assembly. When at least one screw through the holes 85 in the flange member 79 (and, preferably, there are several screws along such flange member 79) is placed sufficiently close to the device 10, no fastener or adhesive material is needed.

Referring particularly to FIGS. 4–7 and 9, the table 25 includes the top member 27 and a plurality of leg mounting devices 10*a*, 10*b*, 10*c*, 10*d* fixed with respect to the top member 27. In a specific arrangement, the diagonally-opposed devices 10*a*, 10*c* are identical to one another, the diagonally-opposed devices 10*b*, 10*d* are identical to one another, and the devices 10*a*, 10*d* are "mirror images" of the devices 10*b*, 10*c*.

The table top member 27 has first and second corner components 87, 89 and an undersurface 91. First and second leg mounting devices 10*a*, 10*b*, respectively, are adjacent to the first and second corner components 87, 89, respectively, and are fixed with respect to the undersurface 91. In a specific embodiment, the mounting surfaces 21 of such devices 10*a*, 10*b* abut the undersurface 91 but, of course, the invention does not preclude the possibility of some sort of intervening structure, a pad or the like, between the mounting surface 21 of a device 10 and the table undersurface 91.

Figure 5:
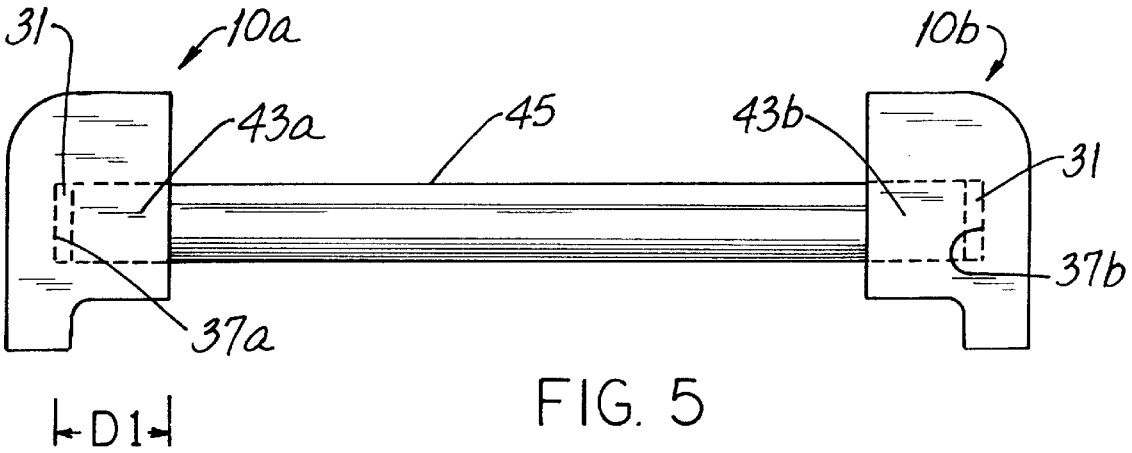
FIG. 5 is a view of two mounting devices and a leg bar of the table shown in FIG. 4. Surfaces of parts are shown in dashed outline.
Figure 6:
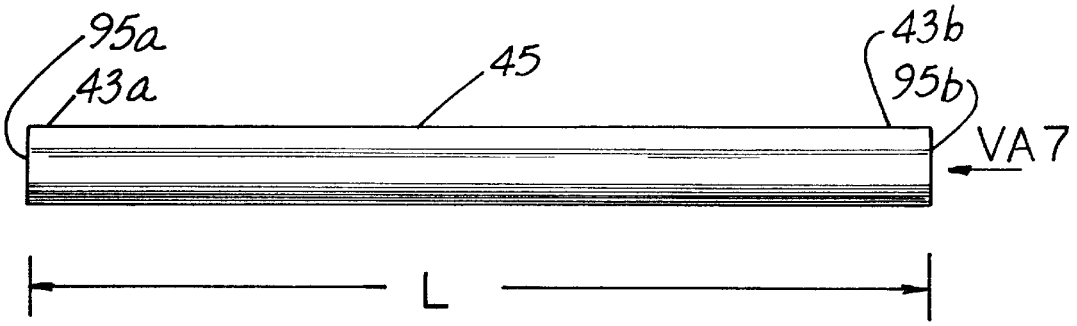
FIG. 6 is an elevation view of a leg bar.
Figure 7:
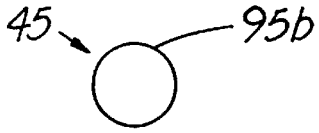
FIG. 7 is an end view of the leg bar of FIG. 6 taken along the viewing axis VA7 thereof.

The table 25 includes an elongate, linear (i.e., free of bends) leg bar 45 which is lateral to the long axis 93 of the table 25, extends between the devices 10*a*, 10*b* and is received in the cavity 31 of each mounting device 10*a*, 10*b*. The bar 45 has first and second ends 43*a*, 43*b*, respectively, which terminate in first and second circular end edges 95*a*, 95*b*, respectively. A typical end edge 95*b* is shown in FIG. 6. FIG. 5 shows the first and second closure walls 37*a*, 37*b*, respectively, in the first and second mounting devices 10*a*, 10*b*, respectively. The closure walls 37*a*, 37*b* substantially cover the first and second end edges 95*a*, 95*b*, respectively.

In a specific embodiment, the bar 45 has a length L and each cavity 31 has a depth D1 measured parallel to the first axis 33. For secure bar retention while yet using a more modest amount of plastic material to make the device 10, the ratio of the depth D1 to the length L is not less than about 5% and not more than about 14%. To state it in a somewhat different way, a pair of mounting devices 10 shrouds not less than about 10% and not more than about 30% of the length L of the bar.

Referring now to FIGS. 1–4 and 8, the table 25 incorporating the devices 10*a*–10*d* has a pair of longitudinal, parallel support beams 69 and a pair of lateral, parallel support beams 71. The ends 99 of the longitudinal beams 69 are received in the chambers 67 formed in the nose portions 49 of the devices 10*a*, 10*b*, respectively, and the ends 101 of the beams 69 are received in the chambers 67 formed in the nose portions 49 of the devices 10*c*, 10*d*, respectively. Similarly, the ends 103 of the beams 71 are received in the chambers 65 formed in the body portions 11 of the devices 10*a*, 10*d*, respectively, and the ends 105 of the beams 71 are received in the chambers 65 formed in the body portions 11 of the devices 10*b*, 10*c*, respectively.

Figure 4:
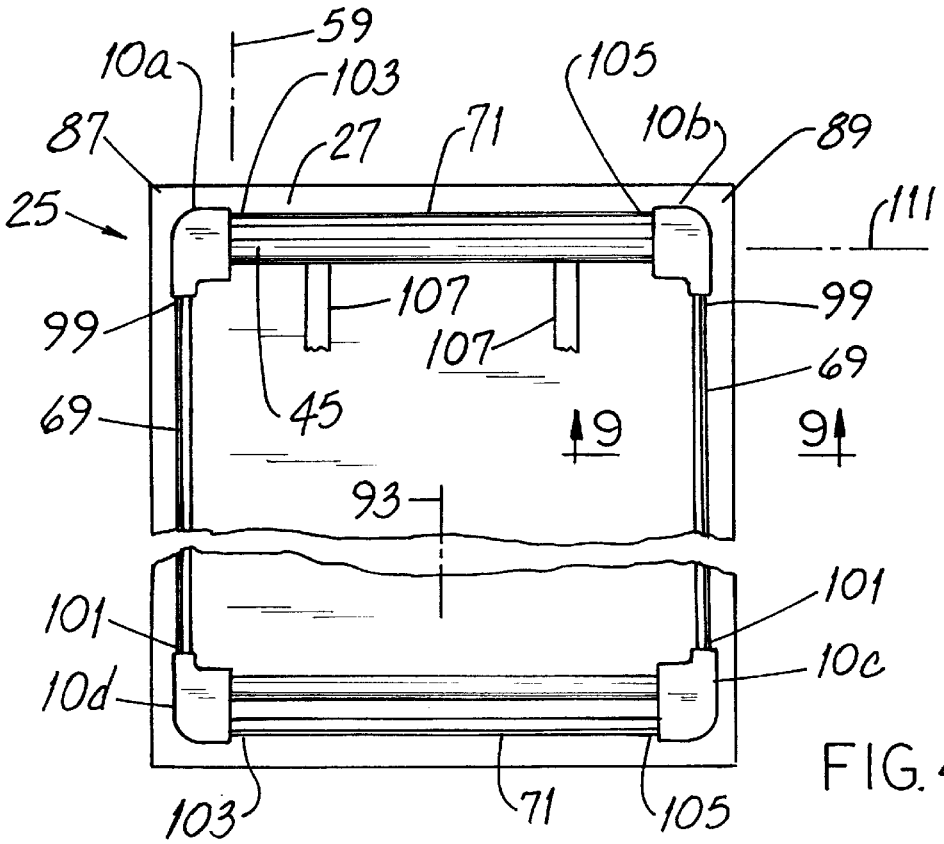
FIG. 4 is a view of the underside of an exemplary table made using the new mounting device. Parts are broken away.

As shown in FIG. 4, the leg structure 107 for each end of the table 25 is attached to a respective bar 45. When such structure 107 is unfolded, the bar 45 pivots in the cavities 31 but is positionally retained so that motion of the bar 45 (with respect to the top member 27) is only about the axis 111.

For greatest strength, the mounting device 10 is molded solid between its exposed working surfaces. Referring to FIG. 3, for reasons relating to possible shrinkage in the mold and to reduction of the volume of plastic material required to make each device 10, such device 10 is preferably molded with a number of partially-hollowed-out regions 113. The device 10 may have an angled bevel-cut corner as shown in FIGS. 1 and 3 or the corners may be rounded as shown in FIGS. 4 and 5.

While the principles have been shown and described in connection with preferred embodiments, it is to be understood clearly that such embodiments are by way of example and are not limiting.

What is claimed:

1. A leg-mounting device for a table comprising:

a body portion having: a plurality of mounting holes therethrough; a leg-bar-receiving cavity formed therein which extends along a first axis, wherein the body portion includes a face intersecting the first axis and the leg-bar-receiving cavity includes an outward edge coincident with the face of the body portion; and a first chamber within the body portion having a length extending substantially parallel to the first axis; and a nose portion extending from the body portion along a second axis angled with respect to the first axis, wherein the first and second axes are substantially on the same plane.

2. The leg-mounting device of claim 1 wherein the face of the body portion and the outward edge of the leg bar receiving cavity are coincident with a single plane.

3. The leg-mounting device of claim 2 further comprising a second chamber formed in the nose portion such that the second chamber has a length extending substantially parallel to the second axis.

4. The leg-mounting device of claim 3 wherein the first axis and the second axis are substantially perpendicular to one another.

5. The leg-mounting device of claim 1 wherein the leg-bar-receiving cavity includes a closure wall such that the closure wall is spaced from the outward edge along the first axis.

6. The leg-mounting device of claim 1 wherein the leg-bar-receiving cavity includes a half-cylinder bearing surface having a radius and a pair of spaced-apart retention surfaces co-extensive with the bearing surface.

7. The leg-mounting device of claim 5 wherein the leg-bar-receiving cavity includes a half-cylinder bearing surface having a radius and a pair of spaced-apart retention surfaces co-extensive with the bearing surface.

8. The leg-mounting device of claim 7 wherein each of the retention surfaces is substantially planar and the retention surfaces are spaced apart by a dimension substantially equal to twice the radius of the half-cylinder bearing surface.

9. A table including a top member, at least one leg bar, at least one support beam, and a plurality of leg-mounting devices fixed with respect to the top member, each leg-mounting device of the plurality of leg-mounting devices comprising:

a body portion having: a plurality of mounting holes therethrough; a leg-bar-receiving cavity formed therein which extends along a first axis, wherein the body portion includes a face intersecting the first axis and the leg-bar-receiving cavity includes an outward edge coincident with the face of the body portion; and a support-beam-receiving chamber within the body portion having a length extending substantially parallel to the first axis; and a nose portion extending from the body portion along a second axis angled with respect to the first axis.

10. The table of claim 9 wherein:

the top member has first and second corner components and an undersurface; and the plurality of leg-mounting devices includes first and second leg-mounting devices adjacent to the first and second corner components, respectively, wherein the first and second leg-mounting devices are fixed with respect to the undersurface and wherein the at least one leg bar extends between the first and second leg-mounting devices by being received in the leg-bar-receiving cavity in the body portion of the first leg-mounting device and the leg-bar-receiving cavity in the body portion of the second leg-mounting device, respectively.

11. The table of claim 10 wherein:

the leg bar includes first and second ends which terminate in first and second end edges, respectively;

the first and second ends are received in the first and second mounting devices, respectively;

the leg-bar-receiving cavities of the first and second mounting devices include first and second closure walls, respectively; and the first and second closure walls substantially cover the first and second end edges, respectively, of the first and second ends, respectively, of the at least one leg bar.

12. The table of claim 10 wherein:

the at least one support beam includes first and second support beams each of which is received in a support-beam-receiving chamber of the first mounting device and a support-beam-receiving chamber of the second mounting device, respectively;

the first mounting device and the first support beam are coupled to one another by a fastener; and the second mounting device and the second support beam are coupled to one another by another fastener.

13. The table of claim 10 wherein:

the at least one support beam includes first and second support beams each of which is received in a support-beam-receiving chamber of the first mounting device and a support-beam-receiving chamber of the second mounting device, respectively;

the first mounting device and the first support beam are coupled to one another by adhesive; and the second mounting device and the second support beam are coupled to one another by adhesive.

14. The leg-mounting device of claim 9 wherein the face of the body portion and the outward edge of the leg bar receiving cavity are coincident with a plane.

15. A leg-mounting device for mounting at least one leg bar and at least two support beams of a table, the leg-mounting device comprising:

a body portion having a plurality of mounting holes therethrough and a leg-bar-receiving cavity formed therein at a radius and extending along a first axis, wherein the leg-bar-receiving cavity includes a half-cylinder bearing surface and a pair of spaced-apart retention surfaces co-extensive with the bearing surface; and a nose portion extending from the body portion along a second axis angled with respect to the first axis, wherein the first and second axes are substantially on the same plane.

16. A table including a top member, at least one leg bar, at least one support beam, and a plurality of leg-mounting devices fixed with respect to the top member, each leg-mounting device of the plurality of leg-mounting devices comprising:

a body portion having a plurality of mounting holes therethrough and a leg-bar-receiving cavity formed therein at a radius and extending along a first axis, wherein the leg-bar-receiving cavity includes a half-cylinder bearing surface and a pair of spaced-apart retention surfaces co-extensive with the bearing surface; and a nose portion extending from the body portion along a second axis angled with respect to the first axis, wherein the first and second axes are substantially on the same plane.

17. A leg-mounting device for mounting at least one leg bar and at least two support beams of a table, the leg-mounting device comprising:

a body portion having: a planar mounting surface parallel to a planar undersurface; a leg-bar-receiving cavity formed through a face between the mounting surface and the undersurface of the body portion, the leg-bar-receiving cavity ending in a closure wall and having a length which extends along a first axis; and a chamber within the body portion having a length extending substantially parallel to the first axis;

a nose portion extending from the body portion along a second axis angled with respect to the first axis; and a plurality of cylindrically-shaped mounting holes through the body portion from the mounting surface to the undersurface for mounting the leg-mounting device to an undersurface of a top member of the table.

* * * * *

UNITED STATES PATENT AND TRADEMARK OFFICE

CERTIFICATE OF CORRECTION

PATENT NO. : 6,000,346

DATED : December 14, 1999

INVENTOR(S) : Frank L. Pajerski and Kenneth R. Hootnick

It is certified that error appears in the above-identified patent and that said Letters Patent is hereby corrected as shown below:

On the title page item [54], and column 1, line 1, replace "LEG MOUNTING DEVICE AND RELATED TABLE"
with --LEG-MOUNTING DEVICE AND RELATED TABLE--.

Col. 2, line 18
replace "leg mounting"
with --leg-mounting--.

Signed and Sealed this

Fifteenth Day of August, 2000

*Attest:*

Q. TODD DICKINSON

*Attesting Officer*

*Director of Patents and Trademarks*